US007007600B1

(12) United States Patent
Hambright et al.

(10) Patent No.: US 7,007,600 B1
(45) Date of Patent: Mar. 7, 2006

(54) SELECTIVELY POSITIONABLE TRASH COMPRESSING APPARATUS

(76) Inventors: Perry Hambright, 152 Alameda Padre Serra, Santa Barbara, CA (US) 93103; Kevin Nuckels, 1805 E. Mountain Dr., Montecito, CA (US) 93108

( * ) Notice: Subject to any disclaimer, the term of this patent is extended or adjusted under 35 U.S.C. 154(b) by 41 days.

(21) Appl. No.: 10/739,648

(22) Filed: Dec. 18, 2003

(51) Int. Cl.
*B30B 7/00* (2006.01)

(52) U.S. Cl. ..... 100/237; 100/229 A; 100/295; 100/214

(58) Field of Classification Search ..... 100/214, 100/223, 226, 229 A, 229 R, 237, 193, 238, 100/295

See application file for complete search history.

(56) References Cited

U.S. PATENT DOCUMENTS

| | | | | |
|---|---|---|---|---|
| 3,992,905 | A * | 11/1976 | Oberley et al. | 68/241 |
| 4,050,373 | A | 9/1977 | Hellmann | 100/240 |
| 4,128,055 | A | 12/1978 | Hellmann | 100/245 |
| 4,524,685 | A * | 6/1985 | Bergmann | 100/210 |
| 5,619,915 | A | 4/1997 | Wagner et al. | 100/98 R |
| 5,845,567 | A | 12/1998 | Fischer | 100/226 |
| 6,314,874 | B1 | 11/2001 | Martorella | 100/226 |
| 2003/0183709 | A1 * | 10/2003 | Greenlaw | 241/243 |

* cited by examiner

*Primary Examiner*—Derris H. Banks
*Assistant Examiner*—Jimmy Nguyen
(74) *Attorney, Agent, or Firm*—Sturm & Fix LLP

(57) ABSTRACT

A trash compressing method and apparatus (10) including: a tower unit (11) having a vertical support shaft (20) provided with a plurality of support legs (21); a support unit (12) having a support column (30) slidably disposed on the vertical support shaft (20) and having an upper end provided with a support arm (33) having a downwardly depending shaft element (34) that captivley yet rotatably supports a collar (41) having a plurality of radial arms (42) each provided with a compressing ram (43).

16 Claims, 3 Drawing Sheets

Fig. 4
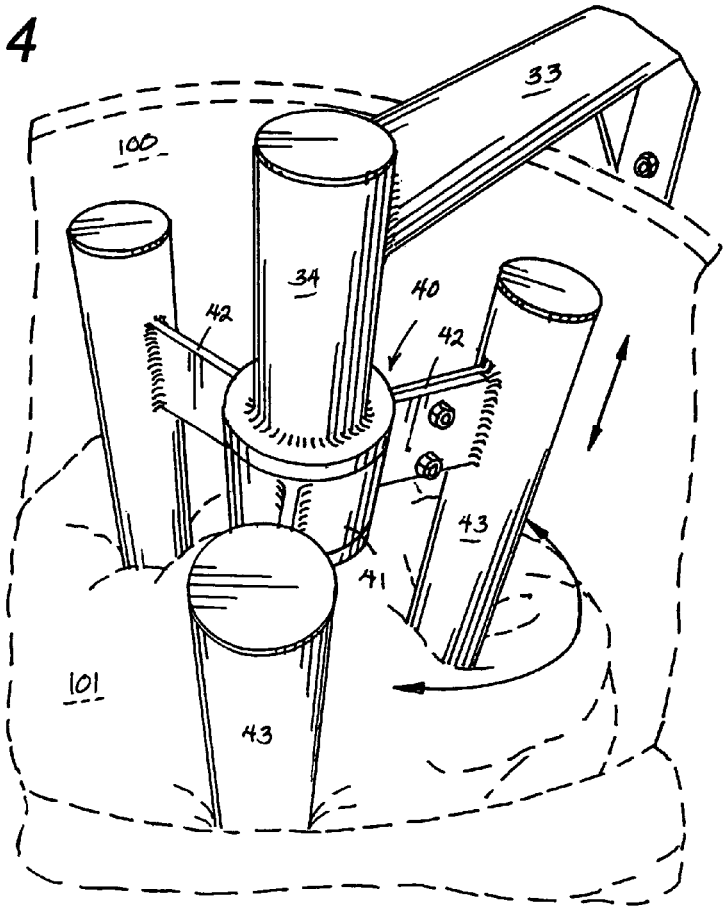
Fig. 5
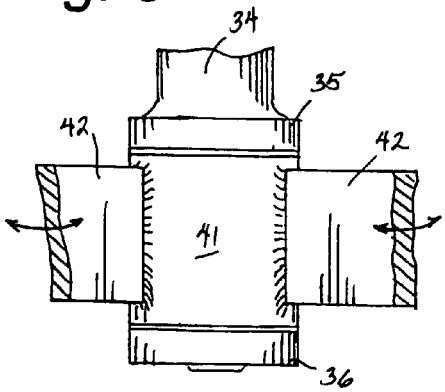
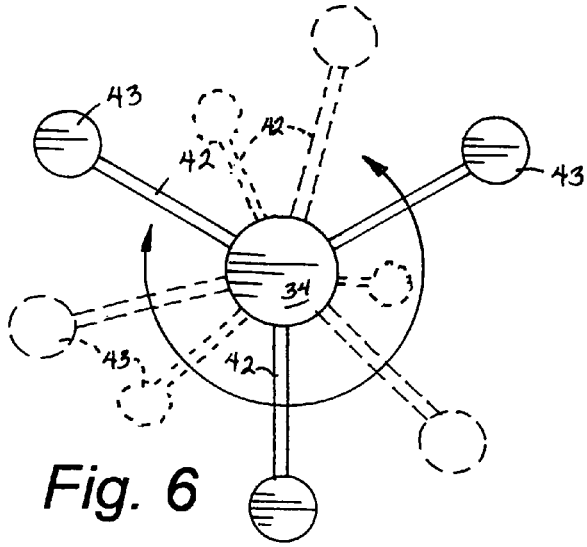
Fig. 6

SELECTIVELY POSITIONABLE TRASH COMPRESSING APPARATUS

CROSS REFERENCE TO RELATED APPLICATIONS

Not applicable.

BACKGROUND OF THE INVENTION

1. Field of the Invention

The present invention relates to the field of human powered trash compressing devices in general and in particular to a selectively positionable trash compressing apparatus that has a significantly more effective pounds per square inch compressive force incorporated into its design 2. Description of Related Art As can be seen by reference to the following U.S. Pat. Nos. 6,314,874; 5,845,567; 5,619,915; 4,128,055; and, 4,050,373, the prior art is replete with myriad and diverse human powered trash compressing devices that utilize a disk shaped compressing plate to provide the compressive force.

While all of the aforementioned prior art constructions are more than adequate for the basic purpose and function for which they have been specifically designed, they are uniformly deficient with respect to their failure to provide a simple, efficient, and practical human powered trash compressing apparatus the design of which substantially increases the psi compressive force capable of being delivered by the apparatus to more efficiently compress the trash into a smaller volume.

Unfortunately, virtually all of the aforementioned prior art constructions employ a generally flat compressing plate which disperses the compressive force over a wide surface area thereby decreasing the effective psi compressing force capable of being delivered to the trash.

As a consequence of the foregoing situation, there has existed a longstanding need particularly in the food service industry for a new and improved selectively positionable trash compressing apparatus that concentrates the compressing force capable of being delivered by the compressing apparatus to reduce the volume of the compressed trash, and the provision of such an apparatus is the stated objective of the present invention.

BRIEF SUMMARY OF THE INVENTION

Briefly stated, the selectively positionable trash compressing apparatus that forms the basis of the present invention comprises in general a tower unit, a movable support unit mounted for vertically reciprocating movement relative to the tower unit and a compressing unit selectively positionable in a rotary fashion relative to the vertically reciprocating support unit.

As will be explained in greater detail further on in the specification, the compressing unit comprises a multi-armed collar member having a plurality of downwardly depending compressing rams wherein, the collar member is rotatably disposed on an upwardly extending vertical shaft element that is a part of the movable support unit.

The movable support unit comprises a support column dimensioned to be slidably received on a portion of the tower unit wherein, the upper end of the support column is provided with a support arm the outer end of which is provided with the vertical shaft element that captively yet rotatably receives the collar member.

In addition, the tower unit in turn comprises a base member having a plurality of support legs and further provided with a vertical support shaft upon which the vertical support column is adapted to reciprocate in a vertical fashion.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 4 is a perspective view of the outer portion of the support unit and the compressing unit;

FIG. 5 is an isolated view of the collar member rotatably attached to the axial shaft of the support unit; and, FIG. 6 is a top plan view showing the rotary displacement of the compressing rams relative to the axial shaft of the support unit.

DETAILED DESCRIPTION OF THE INVENTION

Figure 1:
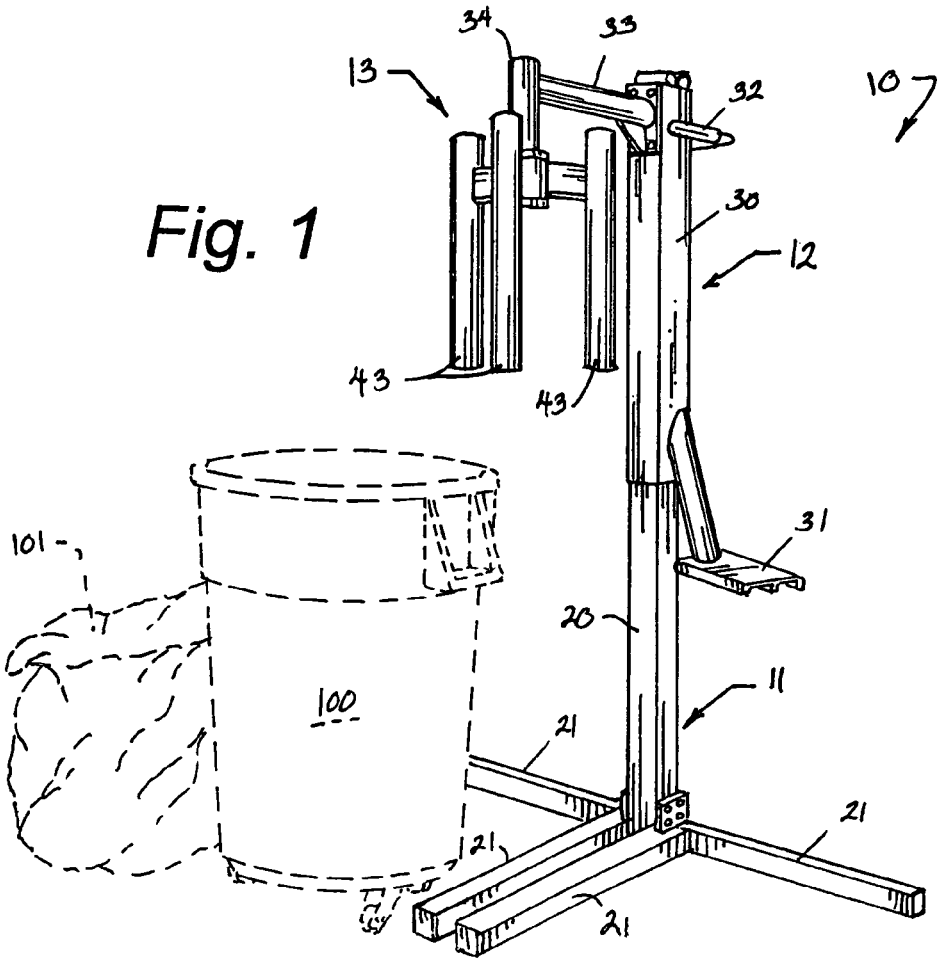
FIG. 1 is a perspective view of the selectively positionable trash compressing apparatus that forms the basis of the present invention.

As can be seen by reference to the drawings, and in particular to FIG. 1, the selectively positionable trash compressing apparatus that forms the basis of the present invention is designated by the reference number 10. The apparatus 10 comprises in general a tower unit 11, a reciprocating support unit 12, and a compressing unit 13. These units will now be described in seriatim fashion.

Figure 2:
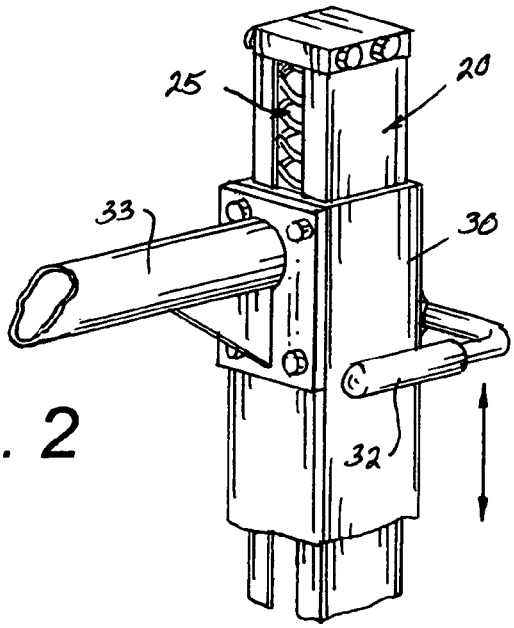
FIG. 2 is an isolated detail view of the inner portion of the support unit and the upper portion of the tower unit.
Figure 3:
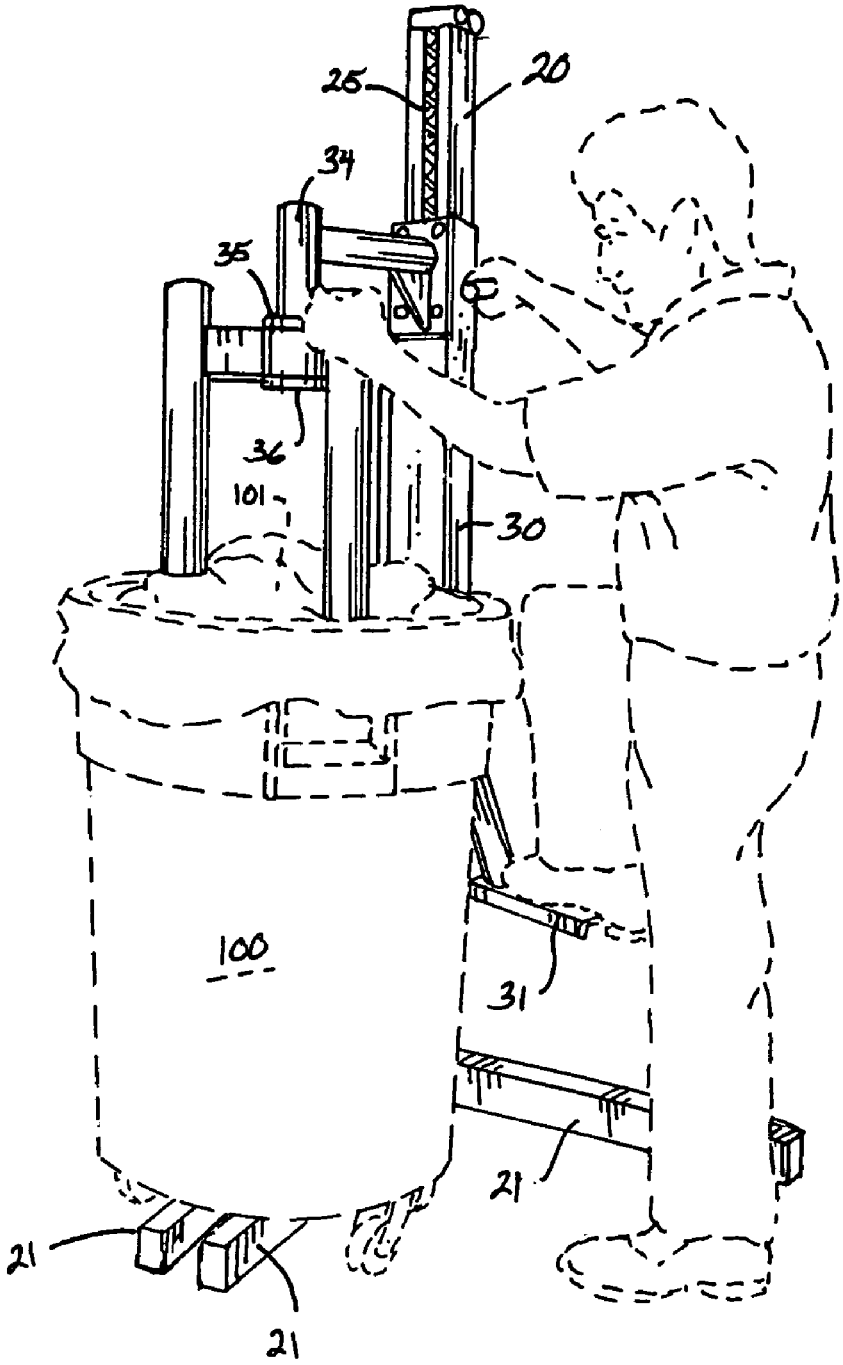
FIG. 3 is a perspective view of the trash compressing apparatus in use.

As can best be seen by reference to FIGS. 1 through 3, the tower unit 11 includes an elongated vertical support shaft 20 the lower end of which is provided with a plurality of elongated support legs 21.

In addition, as can also be seen by reference to FIGS. 1 through 3, the support unit 12 comprises a hollow support column 30 dimensioned to be slidably received on the vertical support shaft 20 wherein, both the support shaft 20 and the support column 30 have a non-circular configuration that precludes relative rotation between the support column 30 and the support shaft 20.

As is also shown in FIGS. 1 through 3, the lower end of the support column 30 is provided with a foot pedal 31 for providing a downwardly directed force on the support column 30 and the upper end of the support column is provided with a handle element 32 vertically aligned with the foot pedal 31 for providing either an upwardly or downwardly directed force on the support column 30.

Furthermore, as can best be seen by reference to FIG. 2, the vertical support shaft 20 is further provided with a spring element 25 that is operatively connected to the support column 30 to normally bias the support column 30 toward the top of the support shaft 20.

Turning now to FIGS. 1 through 4, it can be seen that the upper end of the support column 30 is further provided with an outwardly extending support arm 33 the outboard end of which is provided with a vertical shaft element 34 the purpose and function of which will be described presently.

Turning now to FIGS. 4 through 6, it can be seen that the compressing unit 13 comprises a compressing member designated generally as 40 and including a rotating collar 41 provided with a plurality of radial arms 42 each having at least one downwardly depending compressing ram 43, wherein the collar 41 is in the shape of a tube that is captively yet rotatably received between upper and lower enlarged hub elements 35 36 formed on the lower end of the vertical shaft element 34.

In this manner, the compressing rams 43 are able to concentrate the compressing pressure exerted against a selected portion of the trash 101 within the trash bin 100 when a person steps on the foot pedal 31. Then when the support column 30 is raised via the handle element 32 and the spring 25, the compressing member 40 may be rotated to a new position that will cause the compressing rams 43 to engage a previously un-compressed portion of the trash 101.

By now, it should be appreciated that the rotational re-alignment of the spaced compressing rams 43 relative to the trash 101 allows a much greater compressing force to be exerted against the trash versus the equivalent widespread application of force produced by the flat disk employed in the prior art constructions. The end result of which more easily produces compressed trash which saves the user of this apparatus a substantial amount of money from a trash storage and hauling standpoint.

It should further be noted by reference to FIG. 6 that this invention also contemplates employing radial arms 42 of different lengths such that the compression force exerted against the trash 101 is randomly distributed.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

We claim:

1. An apparatus for compressing a volume of trash in a trash bin, wherein the apparatus comprises:

a tower unit including an elongated vertical support shaft having a plurality of support legs;

a support unit including a hollow column member dimensioned to be slidably received relative to the vertical support shaft wherein, the column member has an upper portion provided with an outwardly extending horizontal support arm and a downwardly depending vertical shaft element having a longitudinal axis;

a compressing unit comprising a compressing member having a collar provided with a plurality of radial arms each provided with a compressing ram having a longitudinal axis oriented parallel to the longitudinal axis of said shaft element, wherein the collar is rotatably disposed on the lower end of the vertical shaft element; and means for moving the column member in a reciprocating fashion relative to the support shaft.

2. The apparatus as in claim 1, wherein the cross-sectional configurations of the support shaft and the hollow column member prevent relative rotation between the support shaft and the hollow column member.

3. The apparatus as in claim 1, wherein the vertical shaft element has a lower end provided with enlarged hub elements that captively yet rotatably receive said collar.

4. An apparatus for compressing a volume of trash in a trash bin, wherein the apparatus comprises:

a tower unit including a vertical support shaft having a plurality of support legs;

a support unit including a column member movably associated with said vertical support shaft wherein, the column member is provided with a horizontal support arm having an outer end provided with a vertical shaft element having a lower end and a longitudinal axis;

a compressing unit including a plurality of radial arms operatively connected to the lower end of the vertical shaft element, wherein each of the radial arms is provided with at least one compressing ram having a longitudinal axis oriented parallel to the longitudinal axis of each compressing ram;

first means for reciprocating the support unit relative to the tower unit; and second means for varying a position of the compressing rams relative to the volume of trash.

5. The apparatus as in claim 4, wherein the radial arms have the same length.

6. The apparatus as in claim 4, wherein the radial arms have different lengths.

7. The apparatus as in claim 4, wherein some of the plurality of radial arms have the same length and others of the plurality of arms have a different length.

8. The apparatus as in claim 4, wherein the compressing unit includes a collar rotatably disposed on the lower end of the vertical shaft elements, wherein said radial arms are fixedly connected to said collar.

9. An apparatus for compressing a volume of trash in a trash bin in a non-uniform fashion wherein, the apparatus comprises:

a compressing unit including a compressing member having a plurality of spaced compressing rams, wherein each compressing ram has a longitudinal axis;

a support unit having an upper end provided with a support arm having an outer end provided with a vertical shaft element connected to the compressing member, wherein said vertical shaft is disposed parallel to the longitudinal axis of each compressing ram;

first means for reciprocating the support unit in a vertical fashion; and, second means for varying a position of the compressing rams relative to the volume of trash.

10. The apparatus as in claim 9, wherein the compressing rams are disposed on radial arms that are operatively connected to the vertical shaft element.

11. The apparatus as in claim 10, wherein the radial arms are fixedly connected to a collar that is captively engaged on the vertical shaft element.

12. The apparatus as in claim 10, wherein the radial arms are fixedly connected to a collar that is rotatably received on the vertical shaft element.

13. The apparatus as in claim 10, wherein the radial arms are fixedly connected to a collar that is both captively engaged and rotatably received on the vertical shaft element.

14. The apparatus as in claim 13, wherein the radial arms have the same length.

15. The apparatus as in claim 13, wherein the radial arms have different lengths.

16. The apparatus as in claim 13, wherein some of the plurality of radial arms have the same length and others of the plurality of arms have a different length.

* * * * *